United States Patent [19]

Frykendahl

[11] Patent Number: 4,630,802

[45] Date of Patent: Dec. 23, 1986

[54] NOZZLE FOR INJECTION LANCE

[75] Inventor: Björn Frykendahl, Hagfors, Sweden

[73] Assignee: IFM Development AB, Gripensas, Sweden

[21] Appl. No.: 541,054

[22] Filed: Oct. 12, 1983

[30] Foreign Application Priority Data

Oct. 15, 1982 [SE] Sweden ..... 8205880

[51] Int. Cl.[4] ..... C21C 5/32

[52] U.S. Cl. ..... 266/225; 266/216; 266/265; 266/270

[58] Field of Search ..... 266/225, 216, 265, 217, 266/266, 267, 270; 75/51, 52, 59, 60; 239/548

[56] References Cited

U.S. PATENT DOCUMENTS

| | | | |
|---|---|---|---|
| 694,348 | 3/1902 | Carson | 266/225 |
| 2,804,339 | 8/1957 | Barbour et al. | 266/217 |
| 2,805,147 | 9/1957 | Schreiber | 266/217 |
| 3,015,481 | 1/1962 | Clingensmith | 266/266 |
| 4,326,701 | 4/1982 | Hayden, Jr. et al. | 75/59 |
| 4,357,004 | 11/1982 | Pelton | 266/225 |

FOREIGN PATENT DOCUMENTS

| | | | |
|---|---|---|---|
| 2912195 | 10/1980 | Fed. Rep. of Germany | 266/225 |
| 1323448 | 7/1973 | United Kingdom . | |
| 2005815 | 4/1979 | United Kingdom | 266/265 |
| 2021242 | 11/1979 | United Kingdom | 266/225 |
| 641004 | 1/1979 | U.S.S.R. | 266/266 |

OTHER PUBLICATIONS

Newton, "Extractive Metallurgy", John Wiley and Sons, Inc., 1959, pp. 260–262.

PCT/SE80/00056, Publ. No. WO 80/01923, published 18 Sep. 80, Title: Refractory Lining for a Metal Pipe.

*Primary Examiner*—L. Dewayne Rutledge
*Assistant Examiner*—Robert L. McDowell
*Attorney, Agent, or Firm*—Nies, Webner, Kurz & Bergert

[57] ABSTRACT

A nozzle (4,5) for an injection lance, which is intended for injecting primarily powderous material into a metal bath, such as a steel bath, freely in a bath or in a casting nozzle, and which comprises preferably an outer, preferably ceramic pipe (1) and an inner, preferably metallic pipe (2), in which said material is intended, usually pneumatically, to be transported all the way to the tip (3) of the lance, at which tip the powderous material is intended to pass out through at least one nozzle (4,5) comprising a through passageway (6) for said material.

The nozzle according to the invention is especially characterized in that the nozzle (4,5) is made of a material with high wear resistance and with a fusion point, which is higher than the fusion point of the material, into which the injection is to be made, for example steel.

15 Claims, 10 Drawing Figures

NOZZLE FOR INJECTION LANCE

Figure 1:
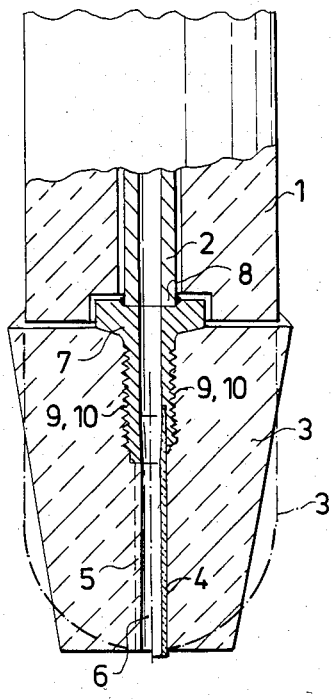

This invention relates to a nozzle for an injection lance, which is intended to inject primarily powderous material into a metal bath, such as steel, freely into the bath or in a casting nozzle.

The injection of powderous material by means of a lance is a process-metallurgical method, which is used, for example, for adding CaSi to steel baths. The material usually is transported pneumatically via a conduit, for example a steel pipe or a rubber or plastic hose, from a sender to a normally vertically fixed lance assembled of a ceramic casing about a pipe, usually of steel. In the lance tip, the pipe is provided with a constriction, a nozzle, out of which the powderous material is intended to flow into the metal bath.

A serious problem at the injection into a steel bath is clogging of the nozzle, which occurs usually with nozzles made of steel and is caused by melting-off and splash-in of steel bath. In order to cope with this problem, usually nozzles of copper (or brass) instead of steel are used, because copper, which has a lower fusing point than steel, is more easily transported away by the gas-material mixture after melting-off and because splash adheres less firmly on a copper nozzle.

Copper nozzles, however, are heavily worn, substantially due to melting-off, whereby the opening in the lance tip increases rapidly with the injection time, and the geometry of the gas-material jet from the lance is changed. This is of less importance where the injection is into a free bath where the main object is to add a certain amount of material during a certain time, and therefore main object is for the nozzle to be open during the injection process. Nozzle wear, thus, is of minor importance in such a case. When the lance tip has been eroded too much, it is exchanged, and usually also the nozzle is replaced. Lance tip exchanges normally take place after each injection cycle where injection is into steel.

In processes where a relatively long injection time is desired, for example longer than twenty minutes, or where there are high requirements on a constant jet geometry, for example as where the injection is into a casting jet (for example according to the Laid-Out Publication Sweden No. 404,497), however, the conventional nozzle design in a practical sense cannot be used. In both of these cases, a substantially unchanged lance tip is required during a long injection time, and especially in the latter case it is important to have a substantially constant jet geometry during a long injection time.

The present invention relates to a nozzle for an injection lance for injection into steel baths, by means of which nozzle the problems referred to above are solved or reduced considerably. A constant jet geometry can be maintained during a long injection time in relation to what is known previously.

The nozzle according to the invention, can also be satisfactorily used for the injection of only gas, for example, so-called gas-flashing.

The present invention, thus, relates to a nozzle for an injection lance, which is intended for injecting primarily powderous material into a metal bath, such as a steel bath, freely into a bath or into a casting nozzle, and which lance preferably comprises both an outer, preferably ceramic pipe, and an inner, preferably metallic pipe, in which said material is intended, usually pneumatically to be transported all the way to the lance tip, at which tip the powderous material is intended to pass out through at least one nozzle comprising a through passageway for said material.

The nozzle according to the invention is especially characterized in that said nozzle is made of a material with high wear resistance and with a fusion point, which is higher in relation to the fusion point of the material, into which the injection is to take place, for example steel.

Figure 2:
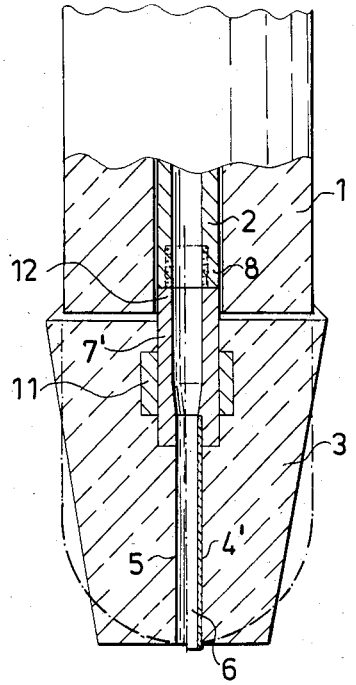
Figure 3:
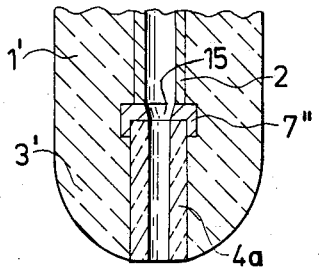
Figure 4:
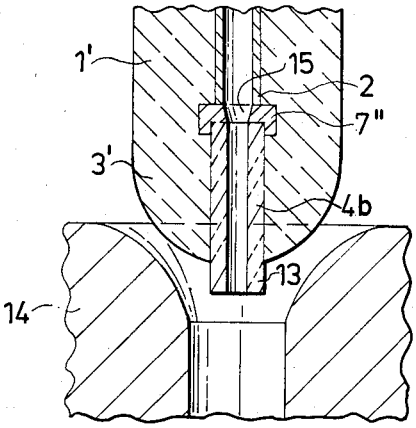
Figure 5:
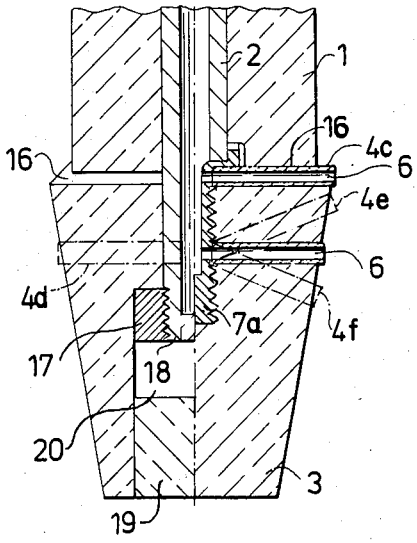
Figure 6:
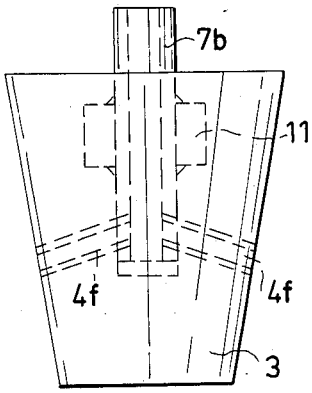
Figure 7:
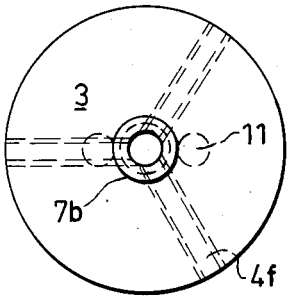
Figure 8:
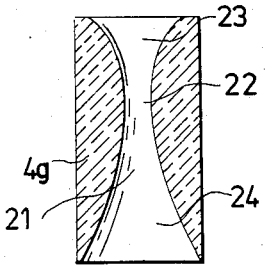
Figure 10:
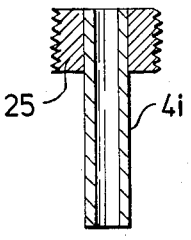
Figure 9:
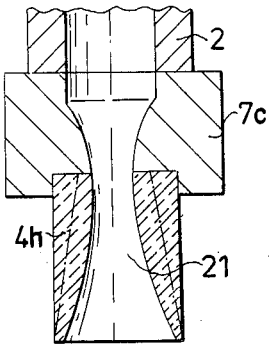

The invention is described in greater detail in the following, with reference to embodiments thereof and to the accompanying drawings, in which FIG. 1 is a central longitudinal section through the end portion of an embodiment of an injection lance provided with a tip, which comprises a first and a second embodiment of nozzles according to the invention, FIG. 2 is a section corresponding to that in FIG. 1 at another embodiment of an injection lance, where the lance tip comprises substantially said first and second embodiments of nozzles, FIG. 3 is a section corresponding to those in FIGS. 1 and 2 through an embodiment of an injection lance suitable at short lances, where the tip comprises a nozzle according to the invention, FIG. 4 is a section corresponding to the section in FIG. 3 through the lance according to FIG. 3, where the lance is intended for injection into a casting nozzle, and where the nozzle comprises a portion projecting outside the lance tip, FIG. 5 is a section corresponding to the sections in FIGS. 1–4, where the lance tip comprises several nozzles and where (a. o.), among other things, different nozzle arrangements are shown, FIG. 6 is a view of an additional embodiment of a lance tip with several nozzles, in this case three nozzles, FIG. 7 is a view from above of the lance tip according to FIG. 6, FIG. 8 is a longitudinal section through a nozzle according to the invention where the through passageway of the nozzle has a Laval-design, FIG. 9 shows an additional Laval-designed through passageway where the passageway partially occurs through a transition piece, and FIG. 10 shows a nozzle according to the invention with a threaded coupling piece.

In FIG. 1 the numeral 1 designates a ceramic outer pipe comprised in an injection lance, and 2 designates a metallic inner pipe located in the pipe 1, in which pipe 2 primarily powderous material, not shown, is intended, usually pneumatically, to be transported all the way to the tip 3 of the lance, at which tip the powderous material is intended to pass out through at least one nozzle 4,5 comprising a through passageway 6, which in its narrowest place is slightly narrower than said inner pipe 2.

To the right of the centre line in FIG. 1, a first embodiment of a nozzle 4 is shown, where the nozzle is tubular and located, secured, in the lance tip 3. To the left in FIG. 1, a second embodiment of a nozzle 5 is shown, where the nozzle 5 is manufactured integral with the lance tip 3, and the through passageway 6 is a passageway in the lance tip 3.

The numeral 7 in FIG. 1 designates a transition piece connected to the end 8 of the pipe 2 located in connection to the lance tip 3, by means of which transition piece the inner pipe 2 communicates with the nozzle 4,5, and in connection to which the nozzle 4,5 is intended to be positioned. Piece 7 is attached to the pipe 2 by weld, threads or the like, and by means of external threads 9 on piece 7 and internal threads 10 in tip 3 the tip 3 is attached to the pipe 2.

The outer profile of the tip 3 can be chosen as desired, for example, as shown fully drawn and dashed in FIG. 1. According to the invention, the nozzle 4,5 is made of a material with high wear resistance and with a high fusion point in relation to the fusion point of the material, into which the injection is intended to be made. Suitable materials in this respect are a ceramic material, such as a carbide, nitride or oxide, or a type of composite material such as metal ceramic or non-metal ceramic, for example a graphitizated oxide.

Suitable materials, more specified, are materials known per se, dense sintered, highly purified aluminium oxide (over 99%), $Al_2O_3$, or a metal ceramic with 10–50% zirconium oxide, $ZrO_2$ and the remainder substantially molybdenum, Mo, or a graphitizated oxide with 28–33% carbon, C, 50–56% $Al_2O_3$ and 14–18% $ZrO_2$.

In the embodiment shown in FIG. 2 the lance tip 3 carries a transition piece 7′ sintered into the lance tip 3 and preferably provided with shoulders 11, see also FIGS. 6 and 7, for fixing the piece 7*b* in the tip 3. A portion 12 of the piece 7 projects from tip 3 to enable the tip being attached to the pipe 2 by a weld, threads or the like. To the left in FIG. 2 an embodiment is shown, which corresponds to that to the left in FIG. 1, i.e. where the lance tip material also provides the wall of the nozzle. To the right is an embodiment with a separate tubular nozzle 4′ which can be sintered together with the tip at the manufacture of the tip or be inserted and fixed later on.

In the embodiment shown in FIG. 3, which is suitable for short lances, for example shorter than 1 meter, the pipe 1′ and lance tip 3′ are manufactured integral with a nozzle insert 4*a*.

In the embodiment shown in FIG. 4, which is substantially identical with that in FIG. 3, the nozzle 4*b* projects by a protruding portion 13 slightly outside the tip 3′ to be used for injection into a casting nozzle 14. The protruding portion 13 acts so as to hold together the jet and reduce the risk of clogging, at the same time as it renders possible a certain control of the bath flow and injection flow in the casting nozzle 14.

As appears, for example, from FIGS. 3 and 4, the transition piece 7″ by means of a conic portion 15 can be adjusted to take up the difference in inner diameter of the pipe 2 and of the nozzle 4*a*or 4*b*.

In FIG. 5 different embodiments of a multi-hole lance with nozzles according to the invention are shown. To the right of the centre line in the Figure, where a transition piece 7*a* of substantially the type shown in FIG. 1 is provided, embodiments are shown where nozzles 4*c*, viz. three nozzles 4 directed radially and spaced equally in the circumferential direction, are arranged either in the gap 16 between the tip 3 and pipe 2 or, preferably, in the tip 3, as are the lower nozzles 4*d*. To the left in the Figure an embodiment is shown where the pipe 2 projects down into the tip 3 and is attached by means of a nut 17 or the like provided in the tip 3, and where the end 18 of the pipe 2 is sealed, and a ceramic plug is provided in the nut hole 20. The nozzle according to the invention here is positioned as shown dashed or in the gap 16.

In certain cases it is suitable, as indicated in FIG. 5, to arrange the nozzles angularly as shown by 4*e* and 4*f* in relation to the axial direction of the lance. A suitable angle depends on the prerequisite conditions at the injection where, in phantom line according to FIG. 5, upward directed nozzles 4*e* are used for injection in ladles close to the bottom, downward directed nozzles 4*f* are used for injection slightly below the bath surface, and horizontal nozzles 4*c* or 4*d* are used for injection at ladle locations therebetween. A suitable angle often is 60° between the axial directions of the nozzles 4*c* and 4*d* and lance.

In FIGS. 6 and 7 the tip of a multi-hole lance is shown where a transition piece 7*b* substantially according to the one shown in FIG. 2 is provided.

In FIGS. 8 and 9 nozzles 4*g* and 4*h* respectively, according to the invention are shown which have the so-called Laval design. A Laval-designed through passageway 21 comprises, seen in the intended flow direction, a portion 23 tapering down through a curved contour to a throttling zone 22, the throttling zone 22 and a portion 24 widening through a curved contour from said throttling zone 22, where said portions in principle are formed in the way shown in the Figures. Straight nozzles as according to FIGS. 1–7 are used when the pressure quotient pressure outside the nozzle/pressure before the nozzle is ≧ a critical value (for $N_2$ 0.528 and Ar 0.486). When the pressure quotient is smaller than the critical value, a Laval-designed nozzle is used, which compared to a straight nozzle offers advantages due to higher outflow rate and a flow free of pulsations.

The entire Laval-design can be formed in the nozzle piece 4*g*, FIG. 8, or can be divided between the nozzle piece 4*h* and a transition piece 7*c*, FIG. 9. In the embodiment according to FIG. 9 the nozzle outer outline can be conic as indicated in phantom line.

The Laval-design, of course, can be utilized in all embodiments shown in FIGS. 1–7, including in the cases where the nozzle and lance tip are manufactured integral.

In order to achieve substantially the same effect as with the Laval-design, a strictly conic portion corresponding to the outlet portion 24, or designs between the Laval-design and the strictly conic one can be used.

Tubular nozzles are intended to be fixed in the lance tip by ceramic binding agents, shrinking, threading or direct connection effected during the manufacture by pressing or casting the ceramic lance tip material. The nozzle 4 suitably is pressed in a hole in the pipe 2 or transition piece 7 and fixed by binding agent, cement, in the hole in the tip 3, into which the nozzle 4 is inserted. Cement also is used for jointing in gaps between, for example, the tip 3 and pipe 1. When the attachment is made by threading, for example in the transition piece 7, the nozzle 4*i* is pressed or correspondingly suitably attached in a threaded coupling piece 25, FIG. 10.

As regards the dimensions of the pipes 1,2 and nozzle 4 etc., they can be chosen within wide limits, depending a.o. on the prerequisite conditions at the injection. The inner diameter of the nozzle 4, for example, can vary between at least 15–90% of the inner diameter of the pipe 2 whereby an area reduction between about 98–20%, respectively, is obtained. A normal inner diameter of the pipe 2 and conduit for pneumatic material supply to the lance is 19 mm. A suitable nozzle inner diameter then is 3–17 mm, depending on the prerequisite conditions at the injection. For injection into steel by a one-hole lance, see for example FIG. 1, a suitable nozzle inner diameter is about 12 mm for powder injection, for example CaSi-injection, and about 6–8 mm for gas injection, flushing. For injection into steel by a three-hole lance, see for example FIGS. 6 and 7, a suitable nozzle inner diameter is about 7 mm for powder injection and about 3 mm for gas injection. With a nozzle inner diameter of about 12 mm, a suitable nozzle wall thickness for commercial aluminium oxide pipes is close to 2 mm, which provides the nozzle with the necessary mechanical strength for being handled and with suitable mechanic properties at operation temperatures. The nozzle outer diameter, however, is not of great importance, but can be permitted to vary according to the standard dimensions of commercial ceramic pipes.

A suitable nozzle length varies with the configuration, in which the nozzle or nozzles are arranged in the tip, and on the tip dimensions. A normal tip length in the axial direction of the tip according to FIGS. 1,2,5,6,7 is 200–250 mm. The Figures yield an understanding of the nozzle length. At a lance according to FIGS. 3 and 4 where lance and tip are integral, a suitable nozzle length in the tip is about 100 mm.

The nozzle can be permitted to continue up to at least 30 mm outside the lance tip 3, FIG. 4, where the length depends on the injection prerequisite conditions. At injection, for example, into a casting jet where the injection lance simultaneously is the stopper end, at a small casting nozzle diameter the injection nozzle can be permitted to project out about 10–30 mm.

Essentially the function of the nozzle according to the invention should be apparent from the aforesaid. In the lance tip, thus, at least one nozzle 4 made of a ceramic or composite material is attached, for example by a ceramic binding agent. The nozzle material, owing to the high wear resistance and high fusion point, has a very long service life with substantially unchanged nozzle geometry. Due to the conic-shaped soft transition between the pipe 2 and nozzle 4, a desirable substantially non-vortical flow is obtained, as is also true in a Laval-nozzle.

As should have become apparent, the nozzle according to the invention offers essential advantages over the prior art. One such advantage is, that with a nozzle having a long service life the lance material can be selected from better and more expensive, materials i.e. materials enabling a longer service life than possible with materials heretofor used, whereby a lance inclusive of nozzle with a long service life is obtained. This is highly desirable, because the availability, i.e. the total operation time or efficiency degree, is improved. It is here presupposed that the tip material is also selected to be better whereby the necessary stability of the nozzle hole(s), among other things is obtained. Furthermore, the advantages of the Laval-design can be utilized, as its geometry will be maintained over a long period of use.

The invention has been described above with reference to various embodiments. It is, of course, possible to imagine more embodiments and minor alterations without abandoning the invention idea.

The group of nozzle materials mentioned above, for example, which comprises carbides, nitrides, oxides and composite materials of the type including metal ceramics and non-metal ceramics, also can include a great number of different materials in addition to those mentioned.

At the embodiment according to the left-hand part of FIGS. 1 and 2, furthermore, a nozzle of a material according to the invention can be inserted into the tip at the manufacture of the tip and be sintered together with the tip, in which case the tip material can be selected independently of the nozzle material. The tip-nozzle, thus, can be manufactured integral and consist of one or several materials, according to demand. This has been indicated dashed at nozzle 5 in FIG. 1.

The invention, thus, must not be regarded restricted to the embodiments set forth above, but can be varied within the scope of the attached claims.

What is claimed is:

1. A nozzle construction for use in combination with an injection lance intended for injecting powderous material into a metal bath, freely in a metal bath or in a casting nozzle, the lance comprises both an outer pipe, made from ceramic, and an inner pipe, made from metal, in which said powderous material is intended to be transported all the way to the lance tip, at which tip the powderous material is intended to pass out through at least one nozzle, comprising an annular wall with a through passageway, in the lance tip, for said powderous material, said nozzle, which includes said annular wall and said through passageway being characterized by being made from a nozzle material with very high wear resistance, on the order of the wear resistance of highly purified $Al_2O_3$, and with a fusion point, which is substantially higher than the fusion point of a metal bath, into which the injection is to be made and in that said nozzle material differs from that of said lance tip, is tubular with an outer diameter substantially smaller than the average outer diameter of the lance tip, and said nozzle material constitutes at least the material of the nozzle wall immediately surrounding the nozzle passageway and the surface of said nozzle passageway, and said tubular nozzle material is separate from and is secured in and to the lance tip.

2. A nozzle as defined in claim 1, characterized in that the nozzle is made of a refractory ceramic material.

3. A nozzle as defined in claim 2, characterized in that the nozzle is made of a dense sintered, highly purified aluminium oxide $Al_2O_3$, with over 99% $Al_2O_3$.

4. A nozzle as defined in claim 1, characterized in that the nozzle is made of a composite material of metal ceramic.

5. A nozzle as defined in claim 4, characterized in that the nozzle is made of a metal ceramic with 10–50% zirconium oxide, $ZrO_2$, and the remainder substantially molybdenum.

6. A nozzle as defined in claim 1, characterized in that the nozzle is made of a composite material of non-metal ceramic.

7. A nozzle as defined in claim 6, characterized in that the nozzle is made of a graphitized oxide with 28–33% carbon, 50–56% $Al_2O_3$ and 14–18% $ZrO_2$.

8. A nozzle as defined in claim 1, characterized in that the nozzle construction is tubular and is contained in and secured to the lance tip by a ceramic binding agent, threading or shrinking or by direct connection made at the manufacture by pressing or casting of a lance tip of a ceramic material.

9. A nozzle as defined in claim 1, characterized in that the end of said inner pipe in connection to the lance tip comprises or adjoins a transition piece, by means of which the inner pipe communicates with one or more nozzles and in connection to which the one or more nozzles are intended to be positioned.

10. A nozzle as defined in claim 1, characterized in that said through passageway has Laval-design and comprises, seen in the intended flow direction, a portion tapering to a throttling place, said throttling place and a portion widening from said throttling place.

11. A nozzle as defined in claim 10, characterized in that at least the portion widening from the throttling place is comprised by the nozzle.

12. A nozzle as defined in claim 1, characterized in that said nozzle is arranged in an exchangeable lance tip, which directly or via a transition piece is intended to be attached to said inner pipe.

13. A nozzle as defined in claim 1, characterized in that said nozzle includes a projecting portion protruding up to about 30 mm outside the lance tip and is to be used for injection into a casting nozzle.

14. A nozzle as defined in claim 1, for injection primarily into steel, characterized in that the nozzle inner diameter for a one-hole lance is about 12 mm for powder injection, such as CaSi-injection, and about 6–8 mm for gas injection, gas flushing, and for a three-hole lance is about 7 mm for powder injection and about 3 mm for gas injection.

15. A nozzle as defined in claim 1, where the lance tip and outer pipe are manufactured integral characterized in that the nozzle length is about 100 mm in the lance tip.

* * * * *